US005519190A

United States Patent [19]

Aoki

[11] Patent Number: 5,519,190

[45] Date of Patent: May 21, 1996

[54] HEATER DRIVING DEVICE FOR SUPPLYING AC POWER TO A HEATER

[75] Inventor: Mikiyuki Aoki, Toyohashi, Japan

[73] Assignee: Minolta Camera Kabushiki Kaisha, Osaka, Japan

[21] Appl. No.: 29,637

[22] Filed: Mar. 11, 1993

[30] Foreign Application Priority Data

Mar. 16, 1992 [JP] Japan ..... 4-057953

[51] Int. Cl.[6] ..... H05B 1/02

[52] U.S. Cl. ..... 219/501; 219/497; 219/505; 332/109

[58] Field of Search ..... 219/497, 499, 219/501, 505, 494, 216; 323/243, 292; 307/117; 332/106, 109

[56] References Cited

U.S. PATENT DOCUMENTS

| | | | |
|---|---|---|---|
| 3,566,148 | 2/1971 | Wood | 323/22 |
| 4,263,501 | 4/1981 | Wilhelmson | 219/497 |
| 4,302,717 | 11/1981 | Olla | 323/282 |
| 4,357,524 | 11/1982 | Apfelbeck et al. | 219/501 |
| 4,580,088 | 4/1986 | Bloomer | 323/238 |
| 4,617,507 | 10/1986 | Eisenhaure et al. | 322/4 |
| 4,689,548 | 8/1987 | Mechlenburg | 323/243 |
| 5,268,631 | 12/1993 | Gorman et al. | 323/246 |
| 5,293,077 | 3/1994 | Seki et al. | 323/288 |

FOREIGN PATENT DOCUMENTS 0373678 6/1990 European Pat. Off. .

*Primary Examiner*—Mark H. Paschall

*Attorney, Agent, or Firm*—Burns, Doane, Swecker & Mathis

[57] ABSTRACT

A heater driving device for supplying AC power to a heater of a fixing device of an image forming apparatus. The heater driving device has self arc suppression type elements between an AC power source and the heater for controlling supply of AC power to the heater in accordance with a control signal supplied to the self arc suppression type elements. The control signal is obtained by modifying signal voltage corresponding to the temperature of the heater in accordance with an absolute value signal which is generated by reducing AC power and converting the reduced AC power to an absolute value, and then comparing the modified signal voltage and a pulse signal generated by a triangular wave oscillator.

13 Claims, 5 Drawing Sheets

HEATER DRIVING DEVICE FOR SUPPLYING AC POWER TO A HEATER

BACKGROUND OF THE INVENTION

1. Field of the Invention

The present invention relates to a heater driving device, for example, a heater driving device of thermal fixing device in an electrophotographic copying apparatus.

2. Description of the Related Arts

Conventionally, electrophotographic copying apparatus and the like comprise a hater driving device. Conventional heater driving device supplies alternating current (hereinafter AC) voltage to a heater, and conducts AC phase control or AC wave number control so as to control temperature. AC phase control turns on a heater every half cycle of AC voltage for a period between a predetermined phase angle and a zero cross point. While, AC wave number control controls supply of power to a heater in accordance with AC wave number present in a predetermined cycle. Thus, neither AC phase control nor AC wave number control can control supply of power to a heater in a shorter cycle, such as a cycle shorter than a half cycle of AC voltage.

On the other hand, a heater driving device is known which uses direct current (hereinafter DC) voltage. A heater driving device using DC voltage is capable of temperature control of great precision by modulating pulse width of DC voltage.

However, since power source for business is AC, a heater driving device using DC voltage necessitates a rectification circuit for converting AC voltage from the power source for business to DC voltage. However, provision of a rectification circuit brings about complication of circuit construction and enlargement of a device.

SUMMARY OF THE INVENTION

A main object of the present invention is to provide a heater driving device capable of temperature control of great precision by a circuit of simple construction.

Another object of the present invention is to provide a heater driving device capable of controlling supply of power to a heater in a shorter cycle.

These and other object of the present invention are achieved by a heater driving device for supplying AC power to a heater, which has switching means provided between an AC power source and the heater for controlling supply of AC power to the heater, signal voltage generating means for generating signal voltage corresponding to the temperature of the heater, modifying means for modifying the signal voltage generated by the signal voltage generating means in accordance with an absolute value signal generated by reducing AC power and converting the reduced AC power to an absolute value, and means for comparing the voltage signal modified by said modifying means and a pulse signal having a frequency shorter than a half cycle of AC voltage and for supplying control signal obtained by the comparison result to said switching means so that said switching means controls the supply of AC power to the heater in accordance with the control signal.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 5:
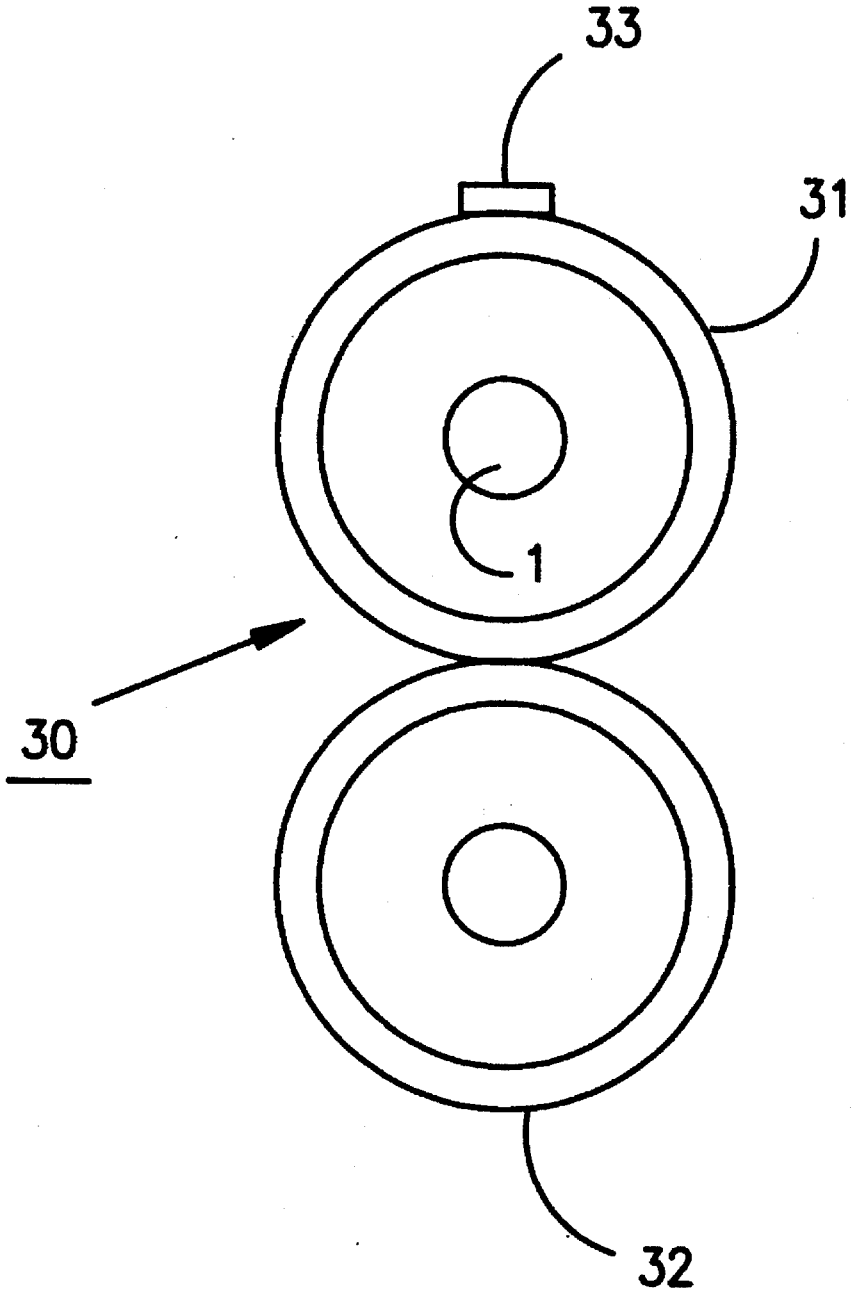
FIG. 5 is an illustration showing a fixing device of an image forming apparatus incorporating a heater.

FIG. 5 shows a fixing device 30 of an image forming apparatus. The fixing device 30 includes an upper fixing roller 31, a lower fixing roller 32, a thermistor 33 contacting with the upper fixing roller 31 for detecting the temperature of the upper fixing roller and the like. The upper fixing roller 31 has a heater 1 therein for thermal fixing.

Figure 1:
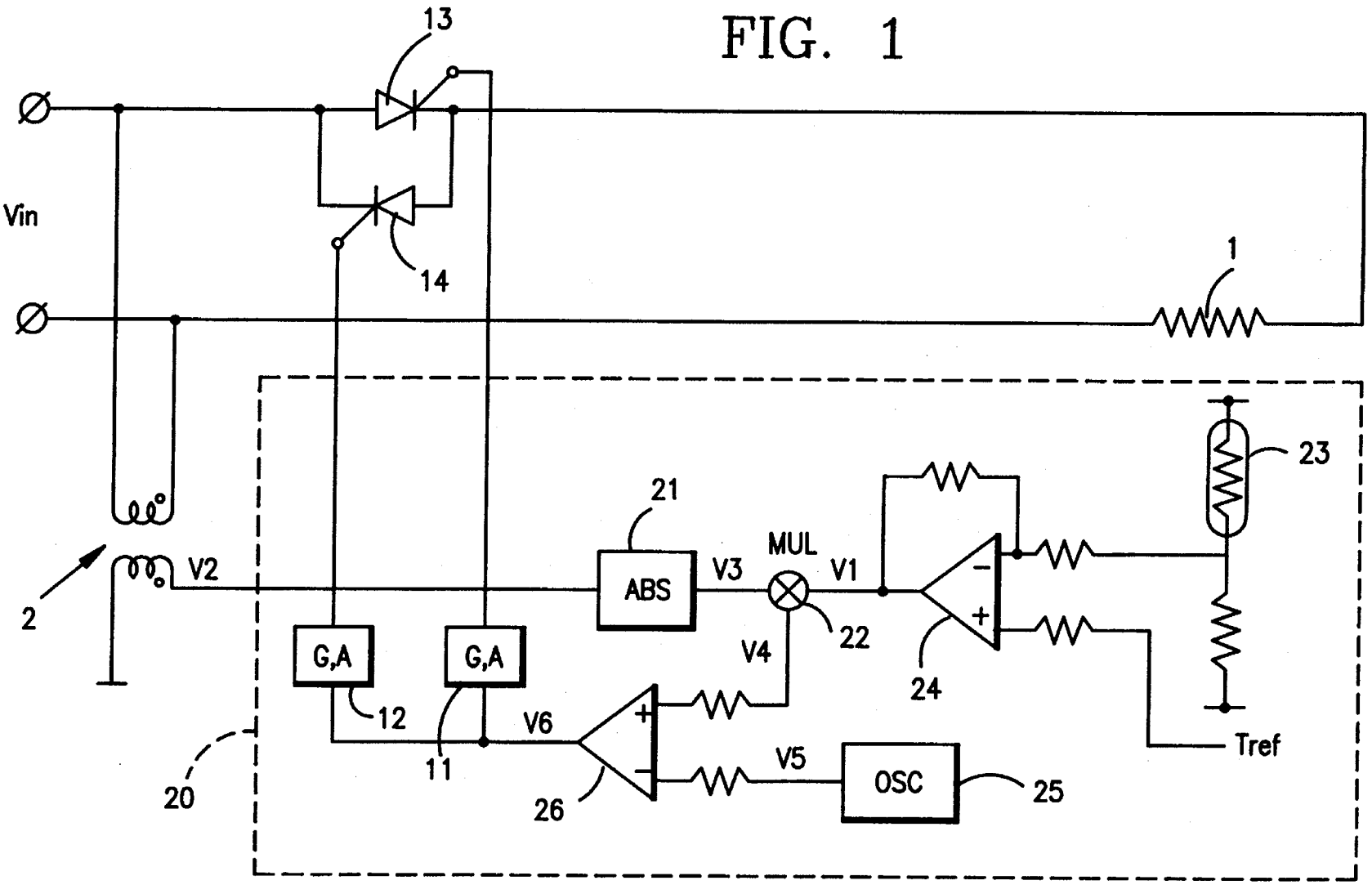
FIG. 1 is an illustration showing a heater driving device of an embodiment of the present invention.

FIG. 1 shows a heater driving device of the present invention for driving the heater 1. The heater driving device provides gate turn off thyristors (hereinafter GOT) 13 and 14, and a control circuit 20 for driving the GOTs 13 and 14.

The control circuit 20 includes gain amplifiers 11 and 12, an absolute value circuit 21, a multiplier 22, a thermistor 23, an amplifier 24, a triangular wave oscillator 25 and a comparator 26. The control circuit 20 is connected with a transformer 2, and AC voltage reduced by the transformer 2 is supplied to the control circuit 20.

The operation of a heater driving device of the present embodiment is described hereinafter.

When AC voltage Vin is applied to a heater driving device, power is supplied to the heater 1 via GOTs 13 and 14. The GOTs 13 and 14 applies voltage to the heater 1 in pulse form in response to the voltage input from the control circuit 20.

Figure 2A:
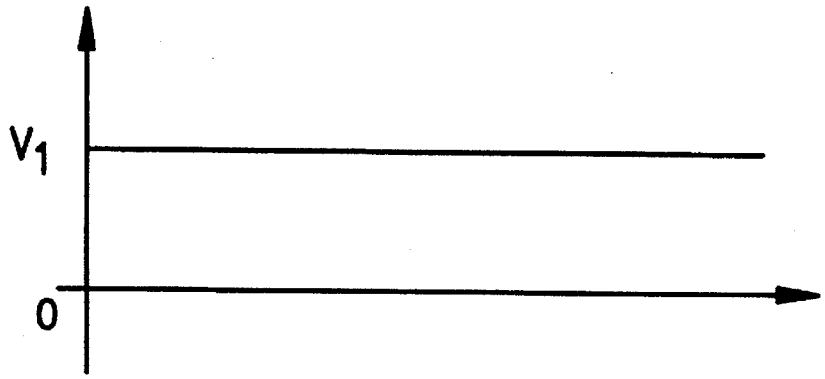
FIGS. 2A through 2D show voltage wave form diagram outputs at a main part of the control circuit of the embodiment.
Figure 2B:
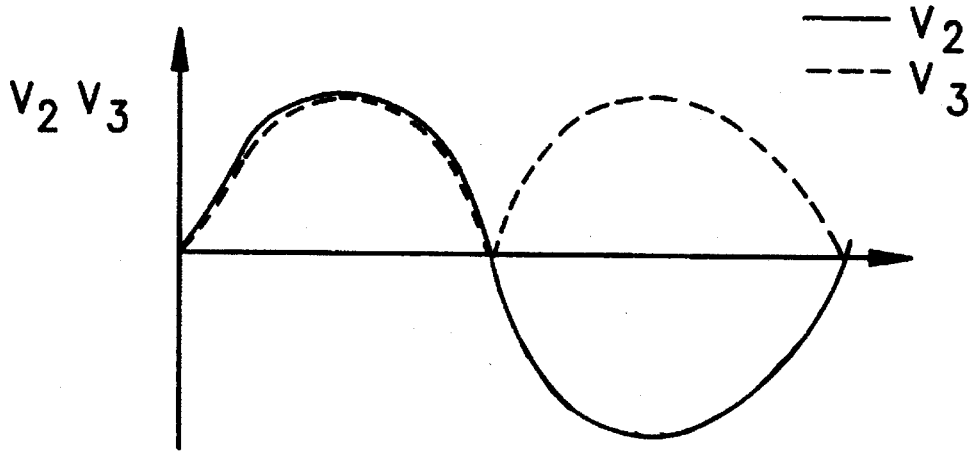
Figures 2C, 2D:
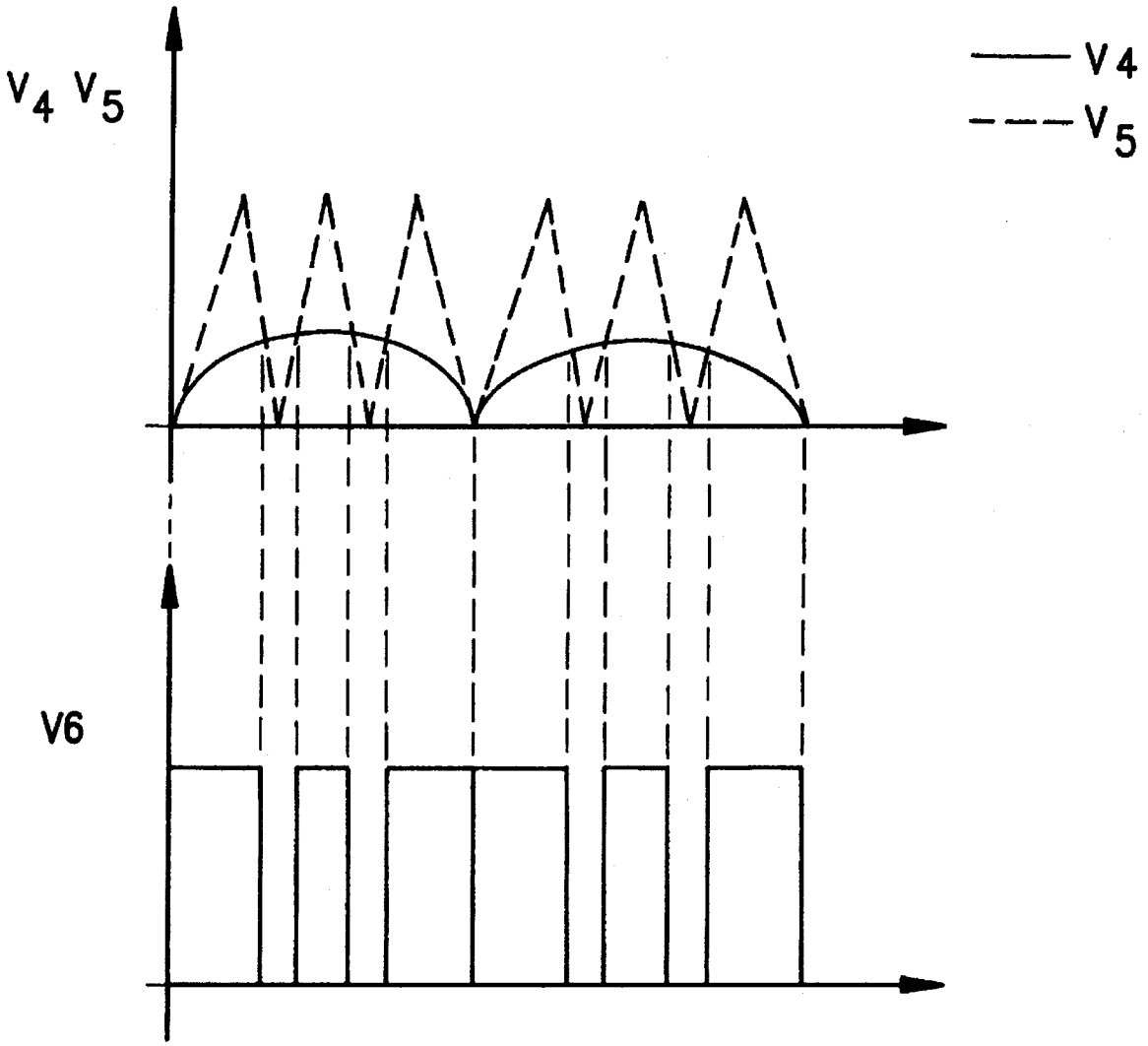

A thermistor 23 provided in the vicinity of the heater 1 varies its resistance in accordance with the temperature of the heater 1. Thus, a signal voltage supplied to the amplifier 24 via the thermistor 23 varies in accordance with the temperature of the heater 1. The amplifier 24 outputs as voltage V1 the difference between the voltage from the thermistor 23 and a predetermined heater temperature reference voltage Tref. (Refer to FIG. 2(*a*).) While, the AC voltage Vin is reduced via the transformer 2 and input to the control circuit 20. Voltage V2, which is reduced from a primary side coil to a secondary side coil of the transformer 2, is input to the absolute value circuit 21. The absolute value circuit 21 outputs voltage V3 which is obtained by converting the voltage V2 to an absolute value. (Refer to FIG. 2 (*b*).) It is to be noted that the absolute value circuit 21 outputs a signal having the same amplitude as an input signal but only single polarity, and thus is equal to a full-wave rectifier circuit. The voltage V3 is multiplied by the aforementioned voltage V1 in the multiplier 22. (Refer to FIG. 2(*c*).) Voltage V4 obtained by the multiplier 22 is compared in the comparator 26 with triangular wave voltage V5 output from the triangular wave oscillator 25. (FIG. 2(*d*).) Voltage V6 is obtained by modulating pulse width in accordance with the comparison by the comparator 26, and is applied to the GOTs 13 and 14 through gain amplifiers 11 and 12. The GOTs 13 and 14 apply voltage to the heater 1 in accordance with the voltage from the gain amplifiers 11 and 12. Since the GOTs 13 and 14 are controlled by the control circuit 20 as described above, the more the temperature of the heater 1 increases, the smaller the pulse width of the voltage supplied to the heater 1 becomes. While, the more the temperature of the heater 1 decreases, the larger the pulse width of the voltage supplied to the heater 1 becomes.

Although the above described embodiment uses GOTs 13 and 14 as self arc suppression type elements of voltage applied to the heater 1, it is to be noted that other self arc suppression type elements may be applied.

Figure 3:
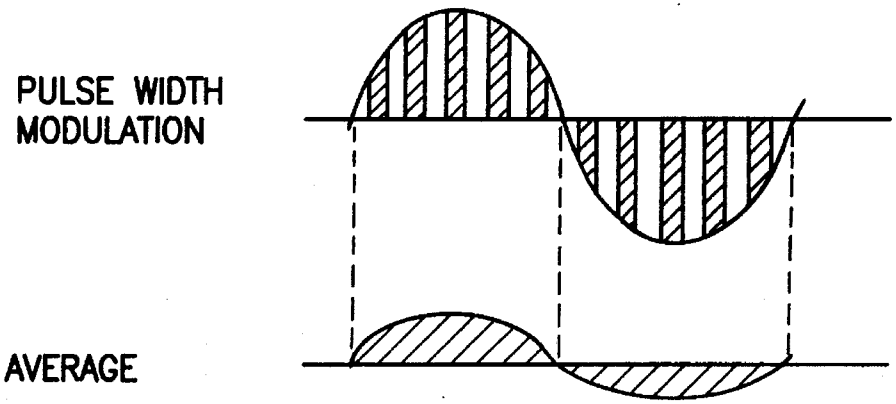
FIG. 3 is a voltage wave form diagram for explaining pulse width modulation of a comparative example of the present embodiment.

Although the present embodiment modulates pulse width of AC voltage supplied to the heater 1 in accordance with the temperature of the heater 1 and the amplitude of the AC voltage, in case of modulating the pulse width according to only the temperature of the heater 1 and regardless of the amplitude of the AC amplitude, it is possible to control supply of power in a short cycle such as less than half cycle of AC voltage as well. However, compared with the present embodiment, the following problem will occur. That is, mere pulse width modulation of the AC voltage causes fluctuation of average value of electric power supplied to the heater. (Refer to FIG. 3) Thus, compared with the present embodiment, minute temperature control is difficult in such an example.

Figure 4:
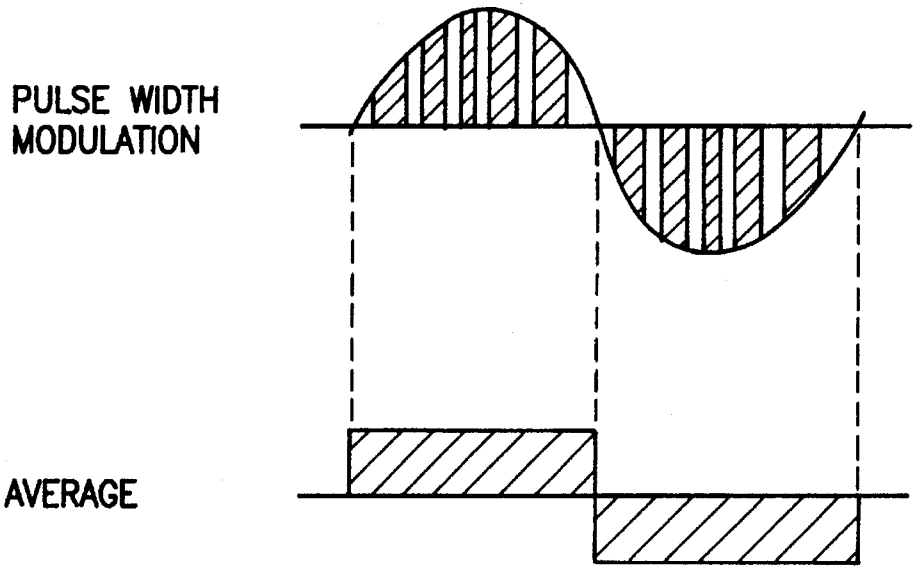
FIG. 4 is a voltage wave form diagram for explaining pulse width modulation of the present embodiment.

To the contrary, according to the present embodiment, the average value of the electric power supplied to the heater is uniform, because pulse width is modulated in accordance with the temperature of the heater 1 and the amplitude of the AC voltage. (Refer to FIG. 4) Thus, the present embodiment is more preferable.

As described above, the present invention makes it possible to simplify the construction of a circuit and to accomplish temperature control of high precision by modulating pulse width in accordance with the temperature of a heater and the amplitude of AC voltage.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A heater driving device for supplying AC power to a heater, comprising:

switching means provided between an AC power source and the heater for controlling supply of AC power to the heater;

first signal generating means for generating a first signal that corresponds to a temperature of the heater;

means for generating an absolute value signal by reducing the AC power and converting the reduced AC power to an absolute value;

signal voltage generating means for generating a signal voltage by modifying the first signal by the absolute value signal; and signal supplying means for supplying a control signal to said switching means so that said switching means controls the supply of AC power to the heater in accordance with the control signal, said control signal being obtained by comparing the signal voltage generated by said signal voltage generating means with a pulse signal having a pulse width shorter than a half cycle of the AC power.

2. The heater driving device as claimed in claim 1, wherein said switching means includes self arc suppression type elements.

3. The heater driving device as claimed in claim 1, wherein said modifying means modifies the first signal by multiplying it by the absolute value signal.

4. The heater driving means as claimed in claim 1, wherein said pulse signal is generated by a triangular wave oscillator.

5. A heater driving device provided in a fixing roller of an image forming apparatus for supplying AC power to a heater, comprising:

switching means provided between an AC power source and the heater for controlling supply of AC power to the heater;

means for generating a first signal corresponding to a temperature of the heater;

modifying means for modifying the first signal generated by said first signal generating means in accordance with an absolute value signal generated by reducing the AC power and converting the reduced AC power to an absolute value; and means for comparing a voltage signal produced by said modifying means with a pulse signal having a pulse width shorter than a half cycle of the AC power, and for supplying a control signal produced by the comparing means to said switching means so that said switching means controls the supply of the AC power to the heater in accordance with the control signal.

6. The heater driving device as claimed in claim 5, wherein said switching means includes self arc suppression type elements.

7. The heater driving device as claimed in claim 5, wherein said modifying means modifies the first signal by multiplying it by the absolute value signal.

8. The heater driving means as claimed in claim 5, wherein said pulse signal is generated by a triangular wave oscillator.

9. A heater driving device for supplying AC power to a heater, comprising:

a switch provided between an AC power source and the heater to control supply of AC voltage to the heater;

a first signal generator which generates a first signal in accordance with a temperature of the heater;

a modifier which modifies the first signal generated by said first signal generator based on the AC voltage to produce a signal voltage;

a pulse signal generator which generates a pulse signal having a pulse width shorter than a half cycle of the AC voltage;

a comparator which compares the signal voltage with the pulse signal generated by said pulse signal generator, and outputs a control signal to said switch so as to control the AC voltage supplied to the heater in accordance with the control signal.

10. The heater driving device as claimed in claim 9, wherein said pulse signal generator is a triangular wave oscillator.

11. The heater driving device as claimed in claim 9, wherein said switch includes self arc suppression type elements.

12. The heater driving device as claimed in claim 9, wherein said first signal generator includes a thermistor which is provided in the vicinity of the heater and outputs a voltage corresponding to the temperature of the heater and an amplifier which outputs the first signal corresponding to a difference between the voltage outputted by the thermistor and a reference voltage.

13. The heater driving device as claimed in claim 9 wherein said modifier includes an absolute value signal generator which converts the AC voltage to an absolute value, and modifies the first signal by multiplying it by the absolute value signal.

* * * * *